US007597548B2

(12) United States Patent
Patterson

(10) Patent No.: US 7,597,548 B2
(45) Date of Patent: Oct. 6, 2009

(54) DUAL ARC VANE PUMP

(75) Inventor: Albert W. Patterson, West Lorne (CA)

(73) Assignee: 1564330 Ontario Inc., Ontario (CA)

( * ) Notice: Subject to any disclaimer, the term of this patent is extended or adjusted under 35 U.S.C. 154(b) by 235 days.

(21) Appl. No.: 11/826,618

(22) Filed: Jul. 17, 2007

(65) Prior Publication Data

US 2008/0019820 A1 Jan. 24, 2008

(30) Foreign Application Priority Data

Jul. 19, 2006 (CA) ..... 2552498

(51) Int. Cl.
*F04C 2/00* (2006.01)
*F04C 18/00* (2006.01)

(52) U.S. Cl. ..... 418/268; 418/82; 418/253; 418/260

(58) Field of Classification Search ..... 418/82, 418/188, 253, 254, 259, 260, 266–268
See application file for complete search history.

(56) References Cited

U.S. PATENT DOCUMENTS 1,515,961 A * 11/1924 Meyer ..... 418/267
2,853,978 A * 9/1958 Smyser ..... 418/266
5,163,825 A * 11/1992 Oetting ..... 418/268
6,554,596 B1 4/2003 Patterson et al.
6,945,218 B2 9/2005 Patterson
2005/0196299 A1 9/2005 Patterson

* cited by examiner

*Primary Examiner*—Theresa Trieu
(74) *Attorney, Agent, or Firm*—Jacobson Holman PLLC

(57) ABSTRACT

A rotary, positive displacement pump for fluids, having a pair of diametrically opposed vanes secured to a rotor in equally spaced, similarly contoured pockets, for movement between an extended position with a portion of the vane extending outwardly beyond the cylindrical surface of the rotor and a retracted position wherein the vane is seated entirely within its corresponding pocket. Each vane is formed of a top curved portion and a bottom curved portion, these portions meeting along a longitudinally extending line. The top portion extends from a pivot to the line and is curved so that when the vane is in retracted position it sits in a peripheral depression extending longitudinally along the rotor surface, the outer surface of this top portion of the vane conforming to the cylindrical surface of the rotor. The bottom portion is curved along a radius from that pivot, so that this lower portion is seated in and fills its corresponding pocket when the vane is in retracted position. The pump construction according to the present invention permits the use of smaller rotors and relatively larger vanes.

4 Claims, 3 Drawing Sheets

DUAL ARC VANE PUMP

FIELD OF THE INVENTION

The present invention relates to a rotary, positive displacement pump for fluids, and more particularly to such a pump having a housed rotor with pivoting paddles.

BACKGROUND OF THE INVENTION

The present invention falls within a family of inventions by the inventor such as those described in U.S. Pat. No. 6,554,596 entitled "FLUID TURBINE DEVICE" issued Apr. 29, 2003 and U.S. patent application Ser. No. 10/680,236, entitled "ROTARY PISTONS". These inventions essentially relate to rotary pistons, motors and pumps having encased rotors with radially extending vanes which move in and out of the rotors, depending on their location within the casing. The vane movement in and out of the rotor is at least partly achieved by cam surfaces within the casing. The walls of the casing are not of uniform radius, and are formed so as to facilitate movement of the vanes and flow of fluid between inlet and outlet ports in the casing.

Also of background interest is the inventor's co-pending U.S. application Ser. No. 10/791,287 entitled HINGED PADDLE PUMP, that application describing and illustrating a rotary, positive displacement pump for fluids having a plurality of paddles secured to the rotor in equally spaced, similarly contoured pockets, for movement between an extended position with a portion of the paddle extending outwardly beyond the cylindrical surface of the rotor and a retracted position wherein the paddle is seated entirely within its corresponding pocket. Each paddle and pocket are configured so that when the paddle is in retracted position, it provides an interior surface which conforms to the cylindrical surface of the rotor and closes the pocket, and between that position and the extended position, it bears against the interior side wall of the housing while still closing the pocket. The paddles are biased outwardly but allowed to move towards retracted position under urging of the interior side wall during operation of the device.

It is an object of the present invention to provide an alternative construction of pump which will have a variety of applications including moving heavy fluids or fluids with solids in them.

SUMMARY OF THE INVENTION

In accordance with the present invention there is provided a rotary pump for fluids including air. The pump comprises a shaft to rotate about a longitudinal axis and a rotor centrally secured to the shaft. The rotor has a body with a cylindrical surface which extends between spaced ends. Rotor disks are secured to the rotor at each end, and secured at their centers to the shaft. A housing encases the shaft, rotor and rotor disks within an internal cavity, with the shaft extending outside of the housing. The housing has interior end walls adjacent to the rotor disks and an interior side wall. Fluid inlet and fluid outlet ports are provided at opposite locations in the side wall. A first portion of the interior side wall of the housing is cylindrical and curved with constant radius over an angle of about approximately 180°. This portion is spaced a constant distance from confronting portions of the cylindrical surface of the rotor. A second portion of the interior side wall of the housing extends between the extremities of the first portion of the interior side wall and is of curvature of greater radius than that of the first portion. The cylindrical surface of the rotor is proximal to the interior side wall of the housing at a point between the inlet and outlet ports about midway on the second portion. The inlet and outlet ports are located in this second portion of the interior side wall of the housing. A pair of pockets in the rotor surface at diametrically opposed locations is provided, each pocket curved along a radius of a different, longitudinally extending axis along the rotor surface and extending into the rotor to one side of, and beyond, the shaft location.

A pair of similarly shaped vanes is secured to the rotor disks by a pivot for pivotal movement along a different one of the longitudinally extending axes along the rotor surface, between an extended position and a retracted position. Each vane is formed of top and bottom curved portions that meet along a longitudinally extending line. The top portion extends from its corresponding pivot to the line and is curved so that when the vane is in retracted position, it sits in a peripheral depression extending end to end along the rotor surface, with a surface of this top portion of the vane conforming to the cylindrical surface of the rotor. The bottom portion of the vane is curved along a radius from the corresponding pivot of the vane. This bottom portion of the vane is configured so as to be seated in and fill its corresponding pocket extending into the rotor to one side of, and beyond, the shaft location. The vanes have shoulders at their sides which are slidably seated in corresponding grooves in the rotor disks. The grooves and shoulders support the vanes and limit the travel of the vanes as they move between retracted position and extended position. Each vane, when in extended position, has the line between the top and bottom portions positioned outwardly beyond the cylindrical surface of the rotor and adjacent the interior side wall of the housing. When the vanes are in retracted position, the top portion of each is seated entirely within its peripheral depression in the rotor. The inlet port and outlet port are positioned so that there is always a vane positioned between those ports.

The vanes and interior side wall of the housing are configured so that, during operation of the device, the vanes are moved towards retracted position under urging of the interior side wall. Each vane is biased toward extended position and moved, against that bias, to retracted position under urging of the interior side wall. The rotor disks, housing and vanes are constructed so that fluid entering the housing through the inlet port is carried by the rotor, in one of a pair of compartments formed between the vanes, the rotor, the rotor disks and corresponding portions of the side wall of the housing, until the vanes and that compartment encompass the outlet port where the fluid is expelled from that compartment and the housing.

Because of the unique configuration of the rotor pockets and depression, and the vanes themselves, smaller rotors incorporating larger vanes, when compared to conventional moving vane positive displacement pumps, are permitted.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the present patent specification as a whole.

BRIEF DESCRIPTION OF THE DRAWINGS

These and other advantages of the invention will become apparent upon reading the following detailed description and upon referring to the drawings in which.

Figure 1:
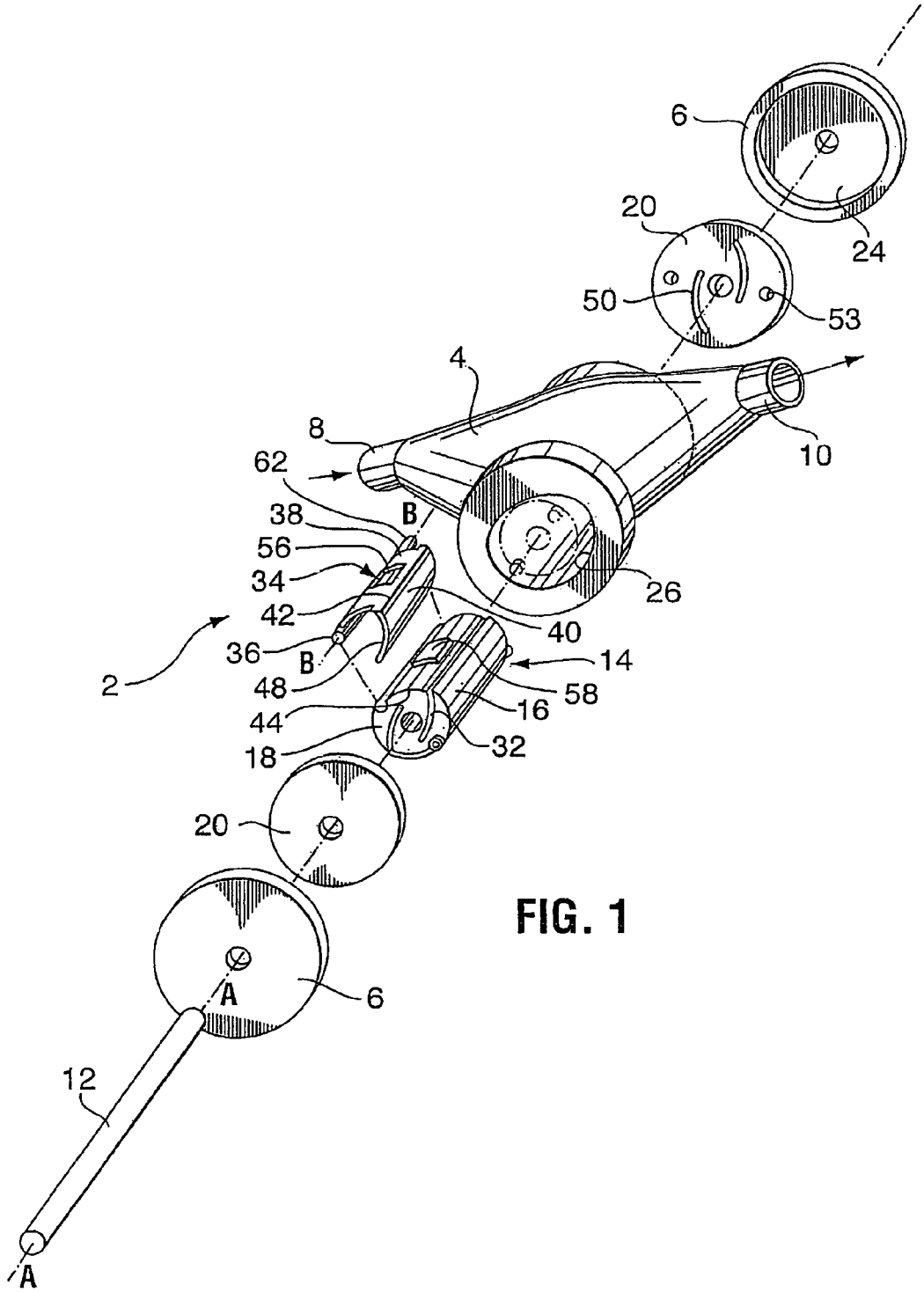
FIG. 1 is an exploded isometric view of a pump in accordance with the present invention.

The present invention will now be described by way of a non-limiting description of certain detailed embodiments.

DETAILED DESCRIPTION OF THE PREFERRED EMBODIMENTS

In the following description, similar features in the drawings have been given identical reference numerals where appropriate. All dimensions described or suggested herein are intended solely to illustrate an embodiment. These dimensions are not intended to limit the scope of the invention, which invention may depart from these dimensions.

Figure 2:
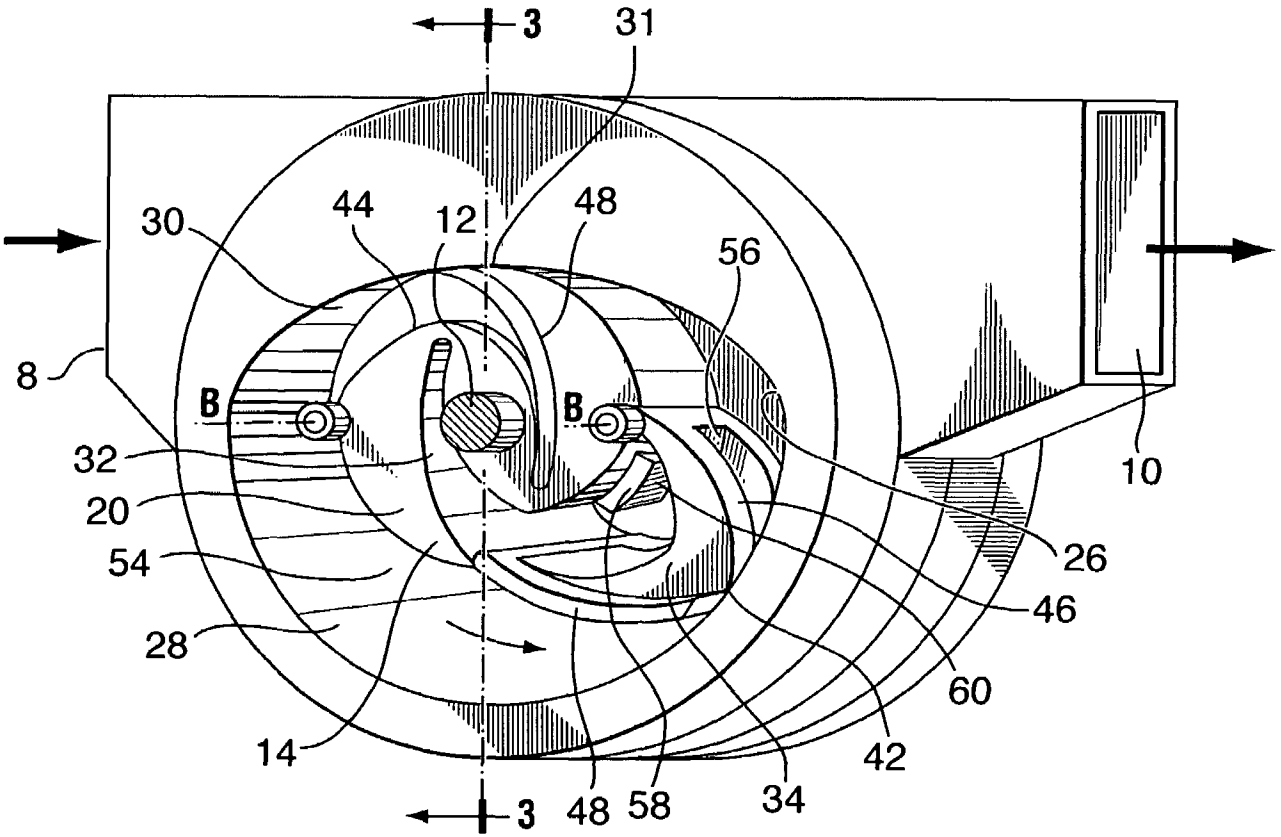
FIG. 2 is an isometric side view of the pump, with one of the pump housing ends and rotor disks removed.
Figure 3:
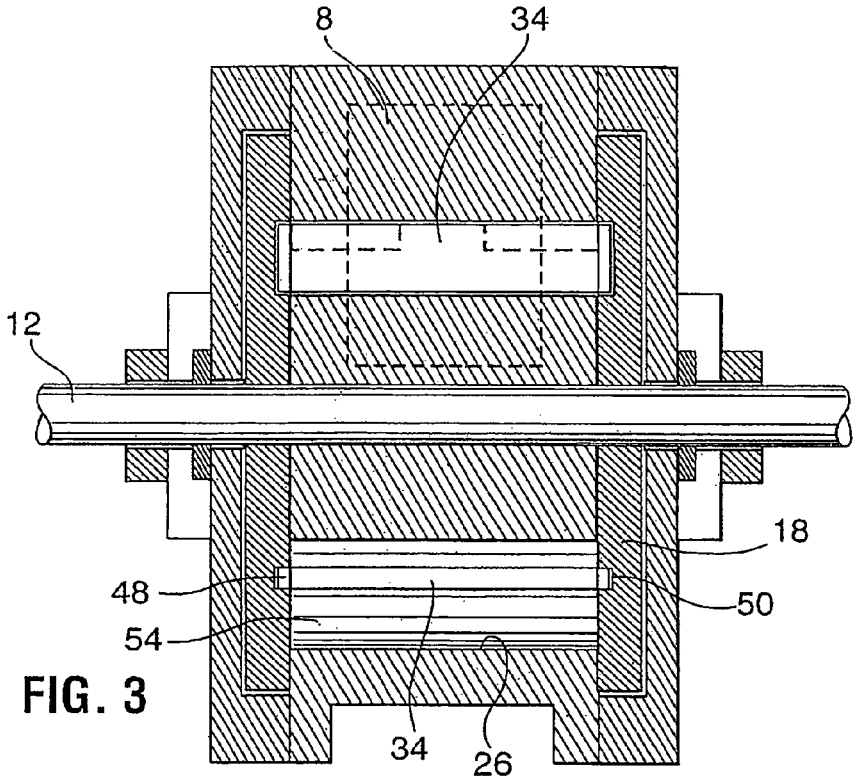
FIG. 3 is a section view of the pump along line 3-3 of FIG. 2 (including both pump housing ends and rotor disks)

Turning to FIGS. 1 and 2, there is illustrated a rotary positive displacement pump 2 in accordance with the present invention, including a housing 4 with housing ends 6, and fluid inlet port 8 and outlet port 10. A shaft 12 extends through housing 4, rotating about a longitudinal axis A. A rotor 14 is centrally secured to shaft 12, the rotor having a body with a cylindrical surface 16 extending between spaced ends 18. Secured to rotor ends 18 are rotor disks 20, again centrally mounted on shaft 12. As can be seen in FIG. 2, housing 4 is provided with an interior chamber bounded by interior surfaces 24 of ends 6 and interior side wall 26 extending between those surfaces 24. A first portion 28 of interior side wall 26 is curved with constant radius over an angle of about 180°, this portion 28 being spaced a constant distance from confronting portions of cylindrical surface 16 of the rotor and a second portion 30 of interior side wall 26, extending between the extremities of first portion 28 and being of a curvature of greater radius than that of the first portion. Cylindrical surface 16 of rotor 14 is proximal to the interior side wall 26 of housing 4 at a point 31 between the inlet port 8 and outlet port 10, which ports are located in this second portion 30 of side wall 26.

A pair of pockets 32 are provided in surface 16 of rotor 14, at diametrically opposed locations. Each pocket is curved along a radius of a longitudinally extending axis B along the rotor surface and extends into the rotor 14 to one side of, and beyond, shaft 12.

A pair of similarly shaped vanes 34 are secured to rotor disks 20 by pivots 36, for pivotal movement with respect to corresponding axis B as illustrated, between an extended position projecting up from rotor surface 16, and a retracted position flush therewith. Each vane is formed of two curved portions, a top portion 38 and a bottom portion 40, these portions meeting along a longitudinally extending line 42. Top portion 38 extends from its corresponding pivot 36 to line 42 and is curved so that when the vane is in retracted position it sits in a peripheral depression 44 extending longitudinally along the rotor surface, the outer surface 46 of top portion 38 conforming to the cylindrical surface 16 of the rotor. Bottom portion 40 of each vane 34 is curved along a radius from the corresponding pivot 36, so that this lower portion is seated in and fills its corresponding pocket 32 when that vane 34 is in retracted position.

Vanes 34 have shoulders 48 at each side, shoulders 48 being slidably seated in corresponding grooves 50 in the rotor disks 20. Grooves 50 and shoulders 48 support the vanes and limit the extent of their travel as they move between retracted position and extended position.

As can be seen in FIG. 2, the lower vane 34, being in extended position, has the line 42, where top portion 38 and bottom portion 40 of vanes meet, positioned at an outward first portion 28 of interior side wall 26. The other vane 26 however, at this point in rotor travel is in fully retracted position, with bottom portion 40 filling pocket 32 and its top portion 38 seated in its corresponding peripheral rotor pocket 44. When the vanes are in retracted position, outer surface 46 of top portion 38 provides a continuum to surface 16 of rotor 14 over peripheral rotor pocket 44.

As can be seen in FIG. 2, inlet and outlet ports 8 and 10 respectively are positioned so that there is always a vane 34 located between these ports.

During operation of the device vanes 34 and the interior side wall 26 are configured so that the vanes are moved towards retracted position under urging of the interior side wall 26.

Figure 4:
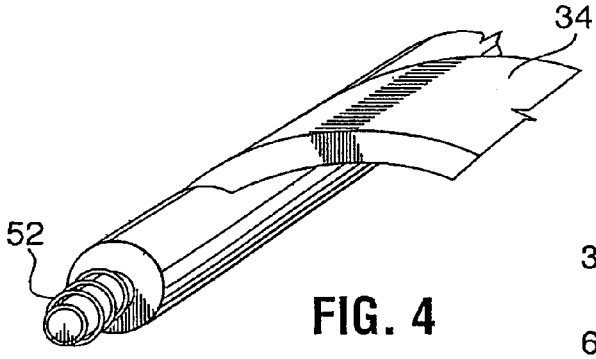
FIG. 4 is a partial isometric view of a vane of an alternative embodiment of pump construction in accordance with the present invention illustrating an embodiment for outward biasing means for the vanes.

The vanes are biased toward extended position either through centrifugal force as rotor 14 spins, or by coil springs 52 (FIG. 4) acting on the pivots 36 of vanes 34. Springs 52 are seated in circular pockets 53 (FIG. 1) in rotor disks 20, which pockets 53 support the ends of pivots 36. In either case, the bias generated on the vanes is overcome and the vanes are moved from extended to retracted position through the cam effect of portion 30 of interior side wall 26 acting on vanes 34.

During operation of pump 2, fluid entering the housing through inlet port 8 is carried in the corresponding one of two compartments 54 between vanes 34 as shaft 12 is mechanically turned, either by hand or mechanical means, to turn rotor 14, until that compartment 54 passes the outlet port 10, where fluid is expelled from that compartment and the housing, as the volume of compartment 54 is collapsed.

To assist in purging fluid from pockets 32 as vanes 34 move to retracted position in the vicinity of outlet port 10, an aperture 56 in top portion 38 of each vane 34 is provided, that aperture allowing escape of fluid from the corresponding pocket 32 into the corresponding compartment 54 as its volume is collapsed while the vanes are moved inwardly to retracted position as they move into the first part of second portion 30 of side wall 26. A mating protrusion 58 is provided within peripheral rotor pocket 44, to fill aperture 56 when vane 34 is in retracted position, the outer surface 60 of protrusion 58 conforming to the cylindrical surface of rotor 14 as illustrated.

Figure 5:
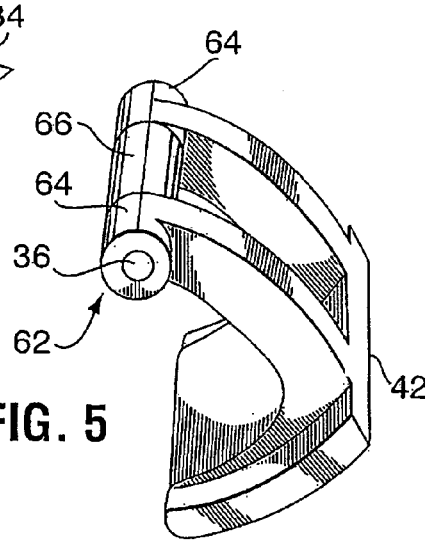
FIG. 5 is a partial isometric view of an alternative embodiment of vane construction in accordance with the present invention.

While the embodiment of the invention illustrated in FIG. 1 shows top portion 38 of each vane 34 as being secured directly to pivot 36, an alternative embodiment of vane construction is illustrated in FIG. 5 where pivot 36 is encased by a sleeve 62. Further strength to the support of vanes 34 by rotor 14 is provided by having sleeve 62 formed with end portions 64 secured to, or integral with, top portion 38 of each vane 34, and a central portion 66 which is secured to the rotor. This reduces the span of the hinge pin, strengthening the pivot arrangement.

This construction of pump 2, by enabling the vanes 34 to pass beyond the rotor centre when in retracted position, permits the use of smaller diameter rotors in conjunctions with relatively larger vanes. The pockets 32 not only extend into the rotor 14 beyond its centre, but also overlap each other, optimizing the use of the space within the small diameter rotor. As well, the strong vane design of the present invention enables the pump to operate with just two vanes, while pressures within the compartments are contained at all times by these two vanes.

While the pump is well suited for movement of liquids, it is also suitable for movement of air and hence may serve as a compressor or a vacuum pump.

Although the present invention has been described by way of a detailed description in which various embodiments and aspects of the invention have been described, it will be seen by one skilled in the art that the full scope of this invention is not limited to the examples presented herein. The invention has a scope which is commensurate with the claims of this patent specification including any elements or aspects which would be seen to be equivalent to those set out in the accompanying claims.

The invention claimed is:

1. A rotary pump for fluids comprising:

a shaft to rotate about a longitudinal axis;

a rotor centrally secured to the shaft, the rotor having a body with a cylindrical surface extending between spaced ends;

a rotor disk secured to the rotor at each end and secured at its center to the shaft;

a housing encasing the shaft, rotor and rotor disks within an internal cavity, the shaft extending outside of the housing, the housing having interior end walls adjacent to the rotor disks and an interior side wall, with fluid inlet and fluid outlet ports at opposite locations in the side wall, a first portion of the interior side wall of the housing being cylindrical and curved with constant radius over an angle of about approximately 180°, this portion being spaced a constant distance from confronting portions of the cylindrical surface of the rotor, and a second portion of the interior side wall of the housing extending between the extremities of the first portion of the interior side wall and being of curvature of greater radius than that of the first portion;

the cylindrical surface of the rotor being proximal to the interior side wall of the housing at a point between the inlet and outlet ports about midway on the second portion, the inlet and outlet ports being located in this second portion of the interior side wall of the housing;

a pair of pockets in the rotor surface at diametrically opposed locations, each pocket curved along a radius of a different, longitudinally extending axis along the rotor surface and extending into the rotor to one side of, and beyond, the shaft location;

a pair of similarly shaped vanes secured to the rotor disks by a pivot for pivotal movement along a different one of the longitudinally extending axes along the rotor surface, between an extended position and a retracted position, each vane formed of two curved portions meeting along a longitudinally extending line, the top portion extending from its corresponding pivot to the line and curved so that when the vane is in retracted position, it sits in a peripheral depression extending end to end along the rotor surface, with a surface of this top portion of the vane conforming to the cylindrical surface of the rotor, and a bottom portion of the vane curved along a radius from the corresponding pivot of the vane, this bottom portion of the vane configured so as to be seated in and fill its corresponding pocket extending into the rotor to one side of, and beyond, the shaft location, the vanes having shoulders at their sides slidably seated in corresponding grooves in the rotor disks, the grooves and shoulders supporting the vanes and limiting the travel of the vanes as they move between retracted position and extended position, each vane when in extended position having the line between the top and bottom portions positioned outwardly beyond the cylindrical surface of the rotor and adjacent the interior side wall of the housing and when retracted position having the top portion of the vane being seated entirely within its peripheral depression in the rotor;

the inlet port and outlet port being positioned so that there is always a vane positioned between those ports, the vanes and interior side wall of the housing being configured so that, during operation of the pump, the vanes are moved towards retracted position under urging of the interior side wall and each vane is biased toward extended position and moved, against that bias, to retracted position under urging of the interior side wall;

the rotor disks, housing and vanes constructed so that, during operation of the device, fluid entering the housing through the inlet port is carried by the rotor, in one of a pair of compartments formed between the vanes, the rotor, the rotor disks and corresponding portions of the side wall of the housing, until the vanes and that compartment encompass the outlet port where the fluid is expelled from that compartment and the housing.

2. A pump according to claim 1, wherein an aperture is provided in the top portion of each of the vanes, the aperture permitting passage of fluid from the corresponding pocket for the vane to the chamber as the vane moves from extended to retracted position with respect to its pockets, the peripheral depression being provided with a protrusion conforming to the aperture so that the aperture mateably fits over this protrusion when the aperture is in retracted position, an outer surface of the protrusion conforming to the cylindrical surface of the rotor.

3. A pump according to claim 1, wherein the vane pivots are seated in pockets in the end disks, and wherein springs are provided in those pockets for biasing the vanes outwardly towards extended position.

4. A pump according to claim 1, wherein the vanes and rotor are configured so that, during operation of the pump, centrifugal force biases the vanes outwardly towards extended position.

* * * * *